US009835408B2

(12) United States Patent
Parks

(10) Patent No.: US 9,835,408 B2
(45) Date of Patent: Dec. 5, 2017

(54) FIREARM CARRYING APPARATUS WITH EXPANDABLE PORTION

(71) Applicant: Matthew Parks, Gulfport, FL (US)

(72) Inventor: Matthew Parks, Gulfport, FL (US)

( * ) Notice: Subject to any disclaimer, the term of this patent is extended or adjusted under 35 U.S.C. 154(b) by 0 days.

(21) Appl. No.: 15/625,193

(22) Filed: Jun. 16, 2017

(65) Prior Publication Data

US 2017/0284766 A1 Oct. 5, 2017

Related U.S. Application Data

(63) Continuation of application No. 14/027,545, filed on Sep. 16, 2013, now abandoned.

(51) Int. Cl.
*F41C 33/00* (2006.01)

(52) U.S. Cl.
CPC ..... *F41C 33/002* (2013.01)

(58) Field of Classification Search
CPC ..... F41C 33/002
See application file for complete search history.

(56) References Cited

U.S. PATENT DOCUMENTS

| | | | | |
|---|---|---|---|---|
| 5,615,811 | A * | 4/1997 | Bell | F41C 23/02 224/150 |
| 7,988,023 | B1 | 8/2011 | Nykoluk | |
| 8,393,504 | B2 | 3/2013 | Scott | |
| 8,430,285 | B2 | 4/2013 | Burnsed, Jr. | |
| 8,733,601 | B2 | 5/2014 | Burnsed, Jr. | |
| 8,857,680 | B1 | 10/2014 | Thompson | |
| 2008/0217371 | A1 | 9/2008 | Wemmer | |
| 2011/0062194 | A1 | 3/2011 | Esch | |
| 2011/0186603 | A1 | 8/2011 | Alford | |
| 2012/0168470 | A1 | 7/2012 | Burton | |
| 2013/0299531 | A1 | 11/2013 | Burnsed, Jr. | |
| 2014/0091115 | A1 | 4/2014 | Haley et al. | |
| 2014/0203053 | A1 | 7/2014 | Rivas-Schlanger | |
| 2014/0252501 | A1 | 9/2014 | Esch | |
| 2014/0346199 | A1 | 11/2014 | Golob et al. | |
| 2015/0083763 | A1 | 3/2015 | Kharlampov | |
| 2016/0169618 | A1 | 6/2016 | Kunkel | |

* cited by examiner

*Primary Examiner* — Reginald Tillman, Jr.
(74) *Attorney, Agent, or Firm* — Thomas Frost

(57) ABSTRACT

The invention is a two-point firearm carrying apparatus attachable to a long gun having a first arm and a second arm. A spring with hooked ends attached to D rings on the arms is covered by a canvass sheath. The spring compresses and expands to allow sighting and use of the gun, and also to hold the sling against the chest when being transported. The first and second arms are adjustable in length depending upon the height and girth of the user.

6 Claims, 6 Drawing Sheets

FIREARM CARRYING APPARATUS WITH EXPANDABLE PORTION

BACKGROUND OF INVENTION

The present invention relates to an adjustable firearm carrying apparatus with a stretchable section for use with a long gun, such as a rifle, shotgun or submachine gun.

In military and law enforcement use, it is desirable to carry a long gun across the chest with the muzzle down, in a safe position. When a sling or the like is used to carry the firearm, the muzzle remains in a safe direction and the firearm is readily available for use. The firearm is secured across the chest when the user has to climb or handle other equipment.

A two-point sling is a strap attached to the firearm at two points. First at the muzzle end, such as the forearm and secondly near the butt end, such as the stock or rear of the receiver. This design is very useful for toting the weapon on one shoulder, across the back, or even across the chest. However, because the sling must be adjusted tight enough not to sag when worn, it is difficult for anything other transport. To solve this problem the three point sling and one point sling were developed.

The three point sling has a strap that attaches to the front and rear attachment points on most long arms, and another strap attaching to the first strap. The design is complex, with a plurality of straps and buckles. When deployed from a gun rack or truck the design prevents the urgent need for a quick response.

The one point sling is a single loop with an attachment device, usually a clip. The user's head and arm are placed through the loop. A section of the loop is an elastic cord so that when the firearm is brought to the user's line of sight, the cord stretches and increases the overall size of the loop. There are a number of drawbacks. Being that there is only one point on the weapon where the sling attaches, the balancing must be precise. Additionally, these slings require the addition of aftermarket parts, such as sling swivels or rings attached at the middle of the firearm, so that proper balancing can be achieved. The elastic cords tend to lose strength, causing the firearm to sag, and eventually lack the ability to retract.

The present invention is a two-point firearm carrying apparatus with the advantage of a long spring encased in a sheath connected to arms of the apparatus attached to the firearm at two distinct points. When worn across the chest, the weapon can be brought up to the user's shoulder for easy sighting, and with plenty of slack. When released the apparatus holds the weapon snugly to the body. The spring is durable and strong enough for a light or heavy weapon. The sheath shrouds the spring preventing it from snagging or pinching.

It is an object of the invention to provide a single two-point strap with an extensible and retractable section comprised of an encased spring.

It is another object of the invention to a single strap apparatus which is easy to transport and controlled with a design comprised of a few parts.

SUMMARY OF THE INVENTION

The general purpose of the present invention, which will be described subsequently in greater detail, is to provide new and improved two-point firearm carrying apparatus.

The invention is a two-point firearm carrying apparatus attachable to a long gun having a first arm and a second arm.

The first arm has a first end threaded through a slotted buckle and affixed to a point on the long gun near the muzzle end. At a second end of the first arm, a D ring is attached. The second arm is also threaded through a slotted buckle and affixed to a point near the butt end of the long gun. At the second end of the second arm, a D ring is also attached.

An expansion member comprised of a spring covered by a sheath is attached to the D rings. The spring compresses and expands to allow sighting and use of the gun, and also to hold the apparatus against the chest when being transported. The first and second arms are adjustable in length depending upon the height and girth of the user.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
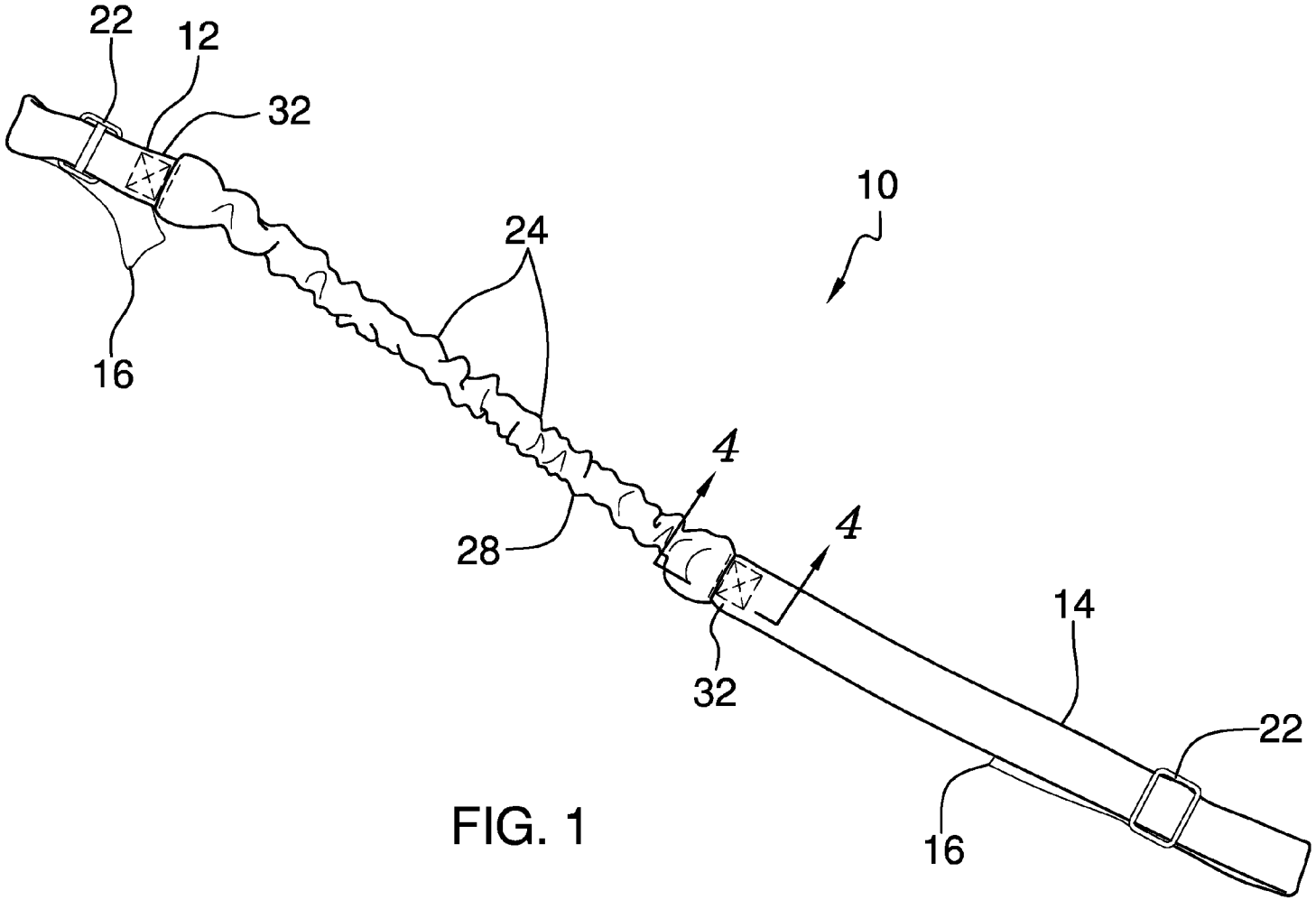
FIG. 1 is a top plan view of an embodiment of the present invention.
Figure 2:
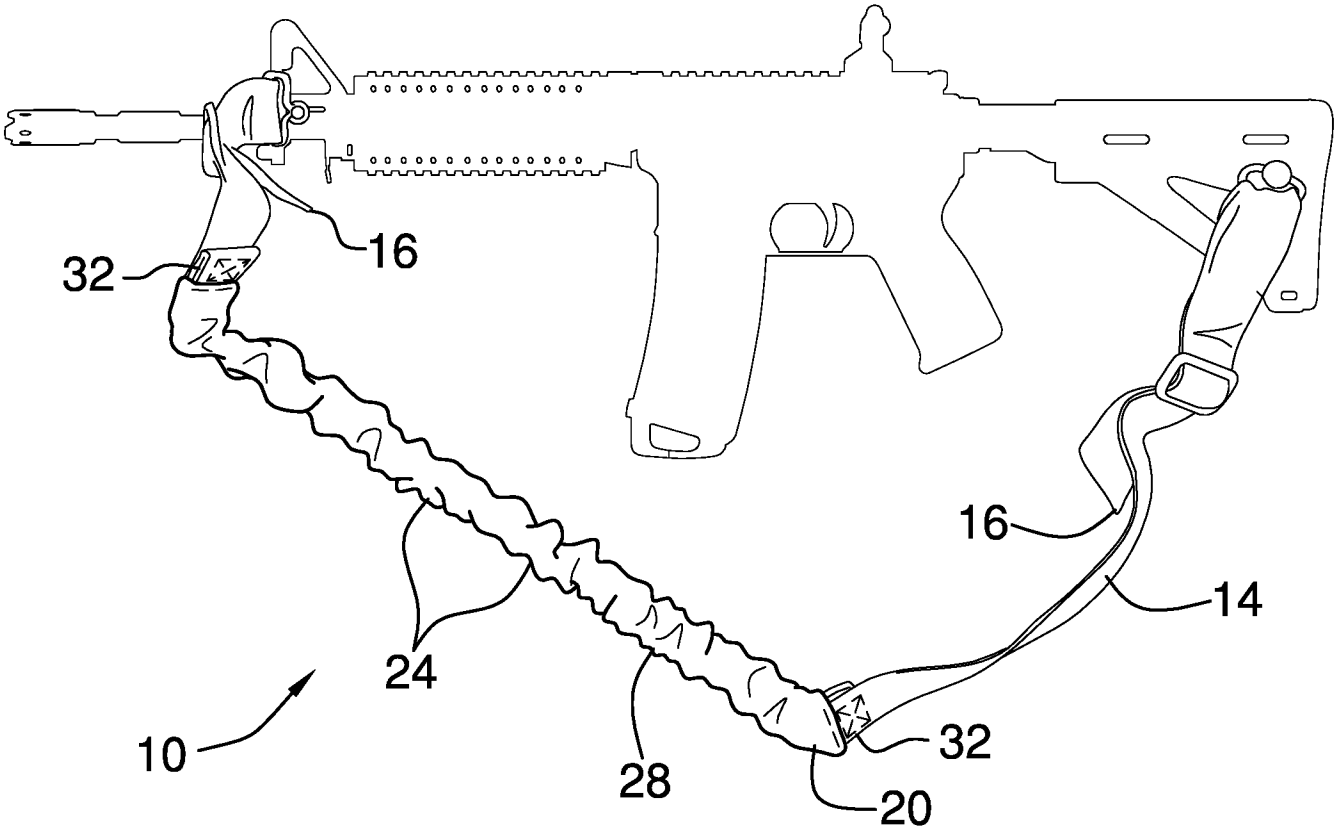
FIG. 2 is a side view of the present invention attached to a firearm.
Figure 3:
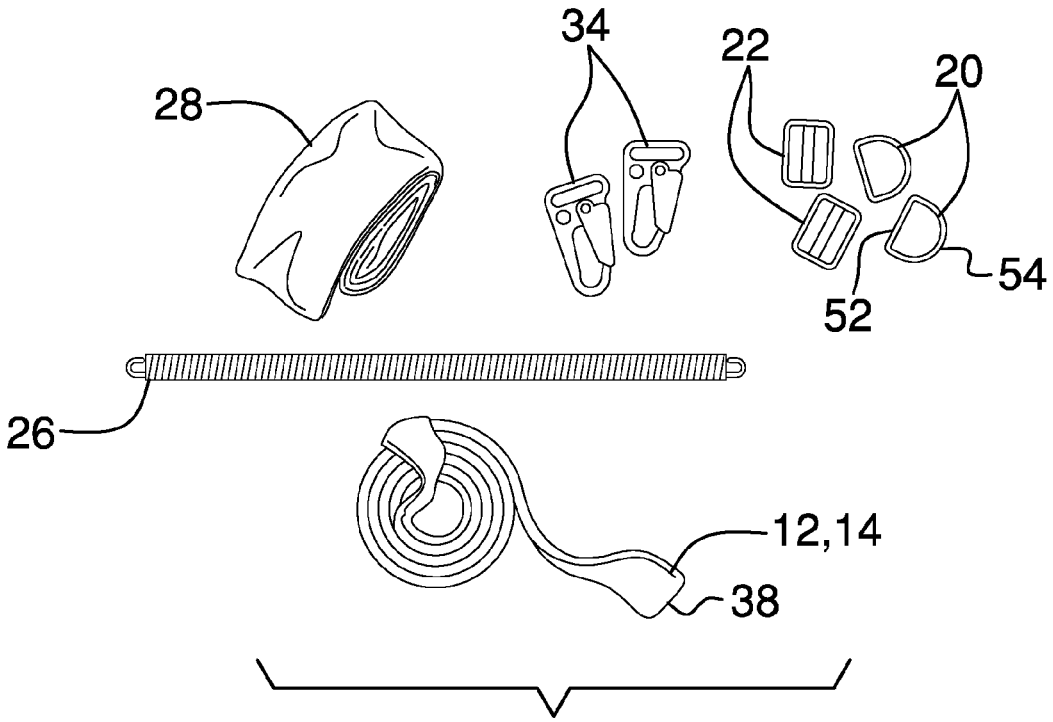
FIG. 3 is a view of the various components of the present invention.

Referring to the drawings in general, an embodiment of the present invention 10 will now be described in greater detail.

Referring to FIG. 1, the strap 10 is comprised of a first arm 12 and a relatively longer second arm 14, each having an upper surface and a lower surface. The arms 12, 14 have first end sections 16 and second end sections 18. A peripheral edge 38 is defined at the second ends 18. The arms 12, 14 are preferably formed of high tenacity polyester yarn. The yarn is wear resistant and provides a tight weave to reduce friction.

Figure 5:
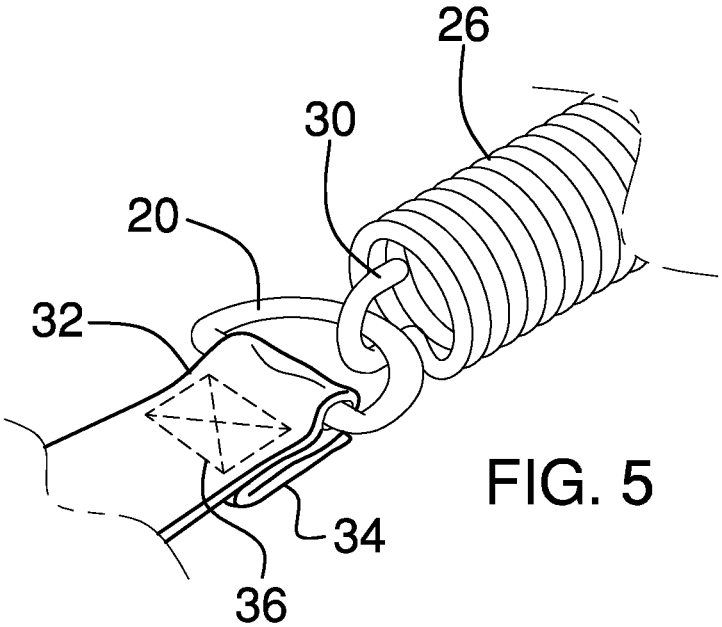
FIG. 5 is a top view with a sheath removed illustrating the spring attached to the D ring and reinforced section of second ends of first and second arms.

The first arm 12 is approximately thirteen inches in length. As illustrated in FIG. 5, a reinforced section 32 is defined at the second end section 18 of the first arm 12 by looping and orienting horizontally to the lower surface of the first arm 12 a pair of folded sections 34 of the first arm 12 and affixing by sewing an X box pattern 36 through the opposed upper surface of the first arm 12. A metallic D shaped ring 20 having a bar portion 52 and an arcuately shaped portion 54 is attached at the second end section 18 of the first arm 12 by inserting the peripheral edge 38 through the ring 20 and snugly fitting the first arm 12 around the bar portion 52 of the ring 20. The reinforced section 32 is then formed. The reinforced section 32 increases the strength of the connection of the first arm 12 to the ring 20, and insures that the peripheral edge 38 is affixed to prevent fraying. A slotted buckle 22 is mounted on the first arm 12 at a pre-determined location. The first end 16 is double backed and threaded through the slotted buckle 22. Thus the length of the first arm 12 is adjustable to define a preferred length for the apparatus 10.

The second arm 14 is approximately thirty seven inches in length. A reinforced section 32 is defined at the second end section 18 of the second arm 14 by looping and orienting horizontally to the lower surface of the second arm 14 a pair of folded sections 34 of the second arm 14 and affixing by sewing an X box pattern 36 through the upper surface of the second arm 14. A metallic D shaped ring 20 having a bar portion 52 and an arcuately shaped portion 54 is attached at the second end section 18 of the second arm 14 by inserting the peripheral edge 38 through the ring 20 and snugly fitting the second arm 14 around the bar portion 52 of the ring 20. The reinforced section 32 is then formed. A slotted buckle 22 is mounted on the second arm 14 at a pre-determined location. The first end 16 is double backed and threaded through the slotted buckle 22. As with the first arm 12, the length of the second arm 14 is adjustable to define a preferred length for the apparatus 10.

An extensible expansion section 24 is connected at a first end to the second end of the first arm, and connected at a second end to the second end of the second arm. The expansion section 24 comprises a helical spring 26 covered by a sheath 28 generally tubular in shape. The sheath 28 extends in length from a first end to a second end, having peripheral ends and has an open interior defined therein. The spring 26 is formed of stainless steel for enhanced corrosion resistance. The spring 26 is approximately 16.5 inches in length, and has tension resistance of approximately 9.5 pounds. The sheath 28 has a passage therethrough for encasing the spring 26 and the rings 20, and is approximately 42 inches in length with a circumference of approximately 1.5 inches, and is composed of high tenacity polyester yarn tube webbing. This composition of material allows for a quicker manufacturing process, and provides material and appearance uniformity between the sheath 28, and the first arm 12 and second arm 14. The spring 26 has hooked shaped appendages 30 at opposed ends which are secured to the rings 20 by engaging with the arcuately shaped portion 54 of the rings 20.

Figure 4:
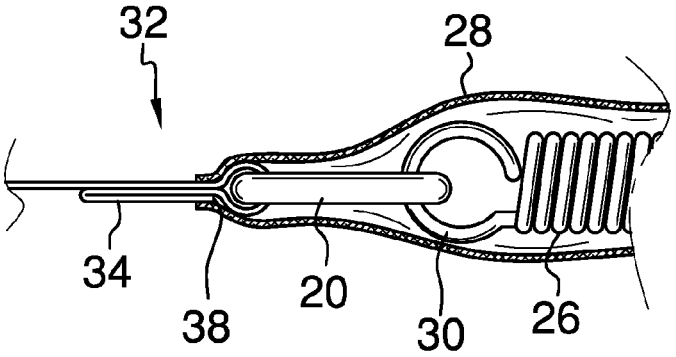
FIG. 4 is a cut away cross-sectional view illustrating a spring attached to D rings.

As illustrated by FIG. 4, peripheral ends of the sheath 28 are mounted over each ring 20, and affixed and secured by reinforced stitching to the second end sections of the arms 12, 14 juxtaposed the reinforced sections 32. When pulled in opposing directions, the hooked shaped appendages 30 of the spring 26 connected to the rings 20, and the arms 12, 14 abutting the bar portion 52 of the rings 20, create opposing forces. The reinforced stitching and reinforced section 32 provide increased support for this higher stress area.

It is also apparent that when the opposed hooked shaped appendages 30 of the spring 26 are engaged with an inner surface of the arcuately shaped portion 54 of the rings 20, respectively, that the appendages 30 are moveable along the inner surface. One of the appendages 30 may remain stationary while the other is repositioned, thus allowing the firearm to be positioned in multiple directions.

Figure 7:
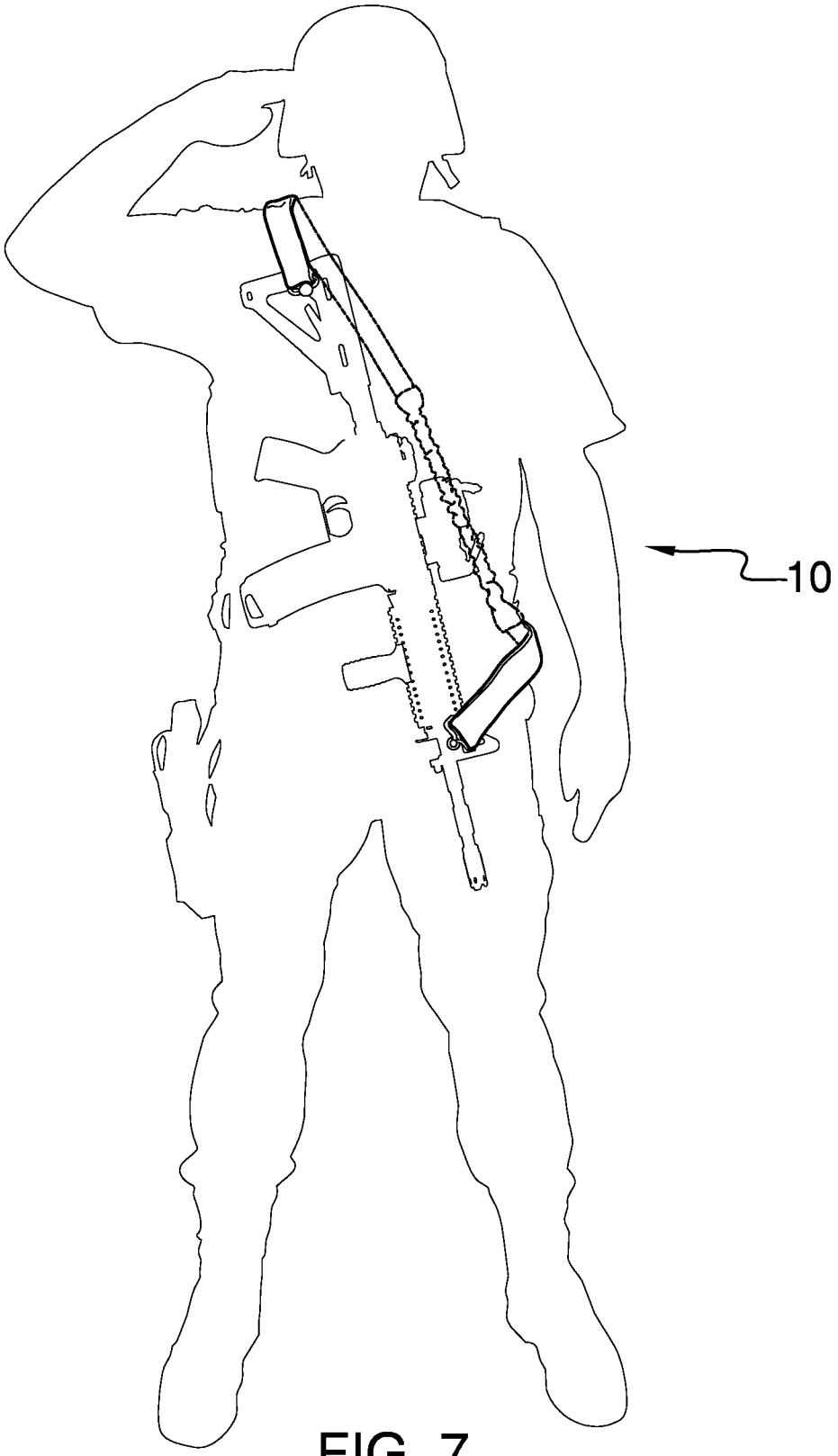
FIG. 7 is a view of the present invention indicating a person using a dual-point carrying apparatus to suspend a firearm over the shoulder.

The first arm 12 is mounted to a firearm by attaching the first arm 12 to attachment means on the firearm (illustrated as a front sling swivel in FIG. 7). Similarly, the second arm 14 is attached to the firearm. Once the apparatus 10 is anchored to the firearm, the firearm is held faced down in front of the user. If the user is right handed the head and left arm of the user are passed through the apparatus 10. If the user is left handed, the head and right arm of the user are passed through the apparatus 10. The firearm is hanging across the chest with the muzzle down. It can readily be seen that the position of the expansion section 24 allows for downward-upward movement of the firearm in all directions.

Figure 6:
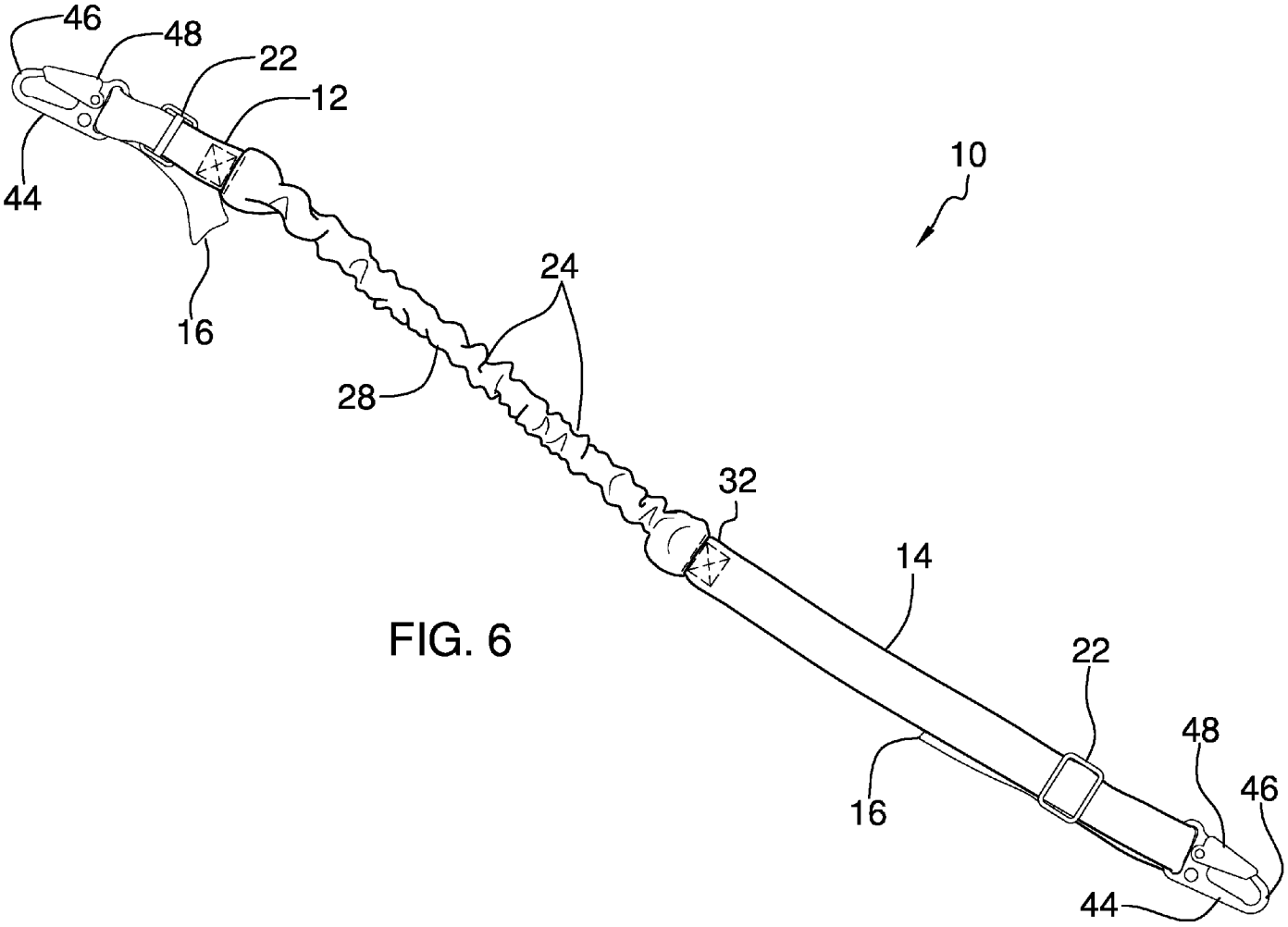
FIG. 6 is a top plan view of a second embodiment of the present invention.

In reference to FIG. 6, a second embodiment of the apparatus 10 is illustrated. Clasps 44 comprised of a hook 46 with spring snap means 48, are secured on the first ends 16 of the second arm 14 and the first arm 12. The clasps 44 are used with firearms having loop type attachment points.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. A two-point firearm carrying apparatus, comprising in combination:

a first arm having a first end section and a second end section having a peripheral edge, an upper surface and a lower surface, the first end section being connectable to attachment means at a first point on the firearm;

a second arm having a first end section and a second end section having a peripheral edge, an upper surface and a lower surface, the first end section being connectable to attachment means at a second point on the firearm;

a first D shaped ring having a bar portion and an arcuately shaped portion, secured at the second end section of the first arm by inserting the peripheral edge through the ring and snugly fitting the first arm around the bar portion of the ring, and by looping and orienting horizontally to the lower surface of the first arm a pair of folded sections of the first arm and affixing the folded sections by sewing an X box pattern through the upper surface of the first arm;

a second D shaped ring having a bar portion and an arcuately shaped portion, secured at the second end section of the second arm by inserting the peripheral edge through the ring and snugly fitting the second arm around the bar portion of the ring, and by looping and orienting horizontally to the lower surface of the second arm a pair of folded sections of the second arm and affixing the folded sections by sewing an X box pattern through the upper surface of the second arm;

a metallic helical spring having hooked shaped appendages at opposed ends which are secured to the rings by the appendages engaging with the arcuately shaped portion of the rings; and a sheath extending in length from a first end to a second end, having peripheral ends and having an open interior defined therein, encasing the spring and the D shaped rings, and affixed and secured by reinforced stitching to the second end sections of the arms juxtaposed reinforced sections.

2. The apparatus as set forth in claim 1, further comprising a pair of slotted buckles, wherein the first end section of the first arm and the first end section of the second arm are threaded through the slotted buckles, respectively, to allow adjustment of a length of the apparatus.

3. The apparatus as set forth in claim 1, whereby the first arm, the second arm and the sheath are formed of high tenacity polyester yarn.

4. A two-point firearm carrying apparatus, comprising in combination:

a first arm having a first end section and a second end section having a peripheral edge, an upper surface and a lower surface, a clasp comprised of a hook with spring snap means being secured on the first end section, and the clasp being connectable to attachment means at a first point on the firearm;

a second arm having a first end section and a second end section having a peripheral edge, an upper surface and a lower surface, a clasp comprised of a hook with spring snap means being secured on the first end section, and the clasp being connectable to attachment means at a second point on the firearm;

a first D shaped ring having a bar portion and an arcuately shaped portion, secured at the second end section of the first arm by inserting the peripheral edge through the ring and snugly fitting the first arm around the bar portion of the ring, and by looping and orienting horizontally to the lower surface of the first arm a pair of folded sections of the first arm and affixing the folded sections by sewing an X box pattern through the upper surface of the first arm;

a second D shaped ring having a bar portion and an arcuately shaped portion, secured at the second end section of the second arm by inserting the peripheral edge through the ring and snugly fitting the second arm around the bar portion of the ring, and by looping and orienting horizontally to the lower surface of the second arm a pair of folded sections of the second arm and affixing the folded sections by sewing an X box pattern through the upper surface of the second arm;

a metallic helical spring having hooked shaped appendages at opposed ends which are secured to the rings by the appendages engaging with the arcuately shaped portion of the rings; and a sheath extending in length from a first end to a second end, having peripheral ends and having an open interior defined therein, encasing the spring and the D shaped rings, and affixed and secured by reinforced stitching to the second end sections of the arms juxtaposed reinforced sections.

5. The apparatus as set forth in claim 4, further comprising a pair of slotted buckles, wherein the first end sections of the first arm and the second arm are threaded through the slotted buckles, respectively, to allow adjustment of a length of the strap.

6. The apparatus as set forth in claim 4, whereby the first arm, the second arm and the sheath are formed of high tenacity polyester yarn.

* * * * *